United States Patent [19]

Pearson

[11] Patent Number: 4,479,567

[45] Date of Patent: Oct. 30, 1984

[54] VERTICAL RAILWAY CAR AIR BRAKE SYSTEM

[75] Inventor: Arthur C. Pearson, St. Charles, Mo.

[73] Assignee: ACF Industries, Incorporated, New York, N.Y.

[21] Appl. No.: 404,205

[22] Filed: Aug. 2, 1982

[51] Int. Cl.[3] ..... B61H 13/38; B61H 15/00

[52] U.S. Cl. ..... 188/47; 188/199

[58] Field of Search ..... 105/1 A, 3, 4 R, 4 A; 188/33, 34, 46, 47, 49, 50, 51, 198, 199, 219.1, 220.1, 231

[56] References Cited

U.S. PATENT DOCUMENTS

| | | | |
|---|---|---|---|
| 1,750,566 | 3/1930 | Browall | 188/198 |
| 1,809,729 | 6/1931 | Sauvage | 188/33 |
| 1,960,716 | 5/1934 | Simanek | 188/46 |
| 2,712,861 | 7/1955 | Gaver | 188/199 |
| 3,404,754 | 10/1968 | Kaim | 188/47 |
| 3,420,339 | 1/1969 | Karakashian et al. | 188/47 |
| 4,346,790 | 8/1982 | Morrison et al. | 188/34 |

FOREIGN PATENT DOCUMENTS

| | | | |
|---|---|---|---|
| 60068 | 11/1968 | German Democratic Rep. | 188/51 |

*Primary Examiner*—Douglas C. Butler
*Assistant Examiner*—R. R. Diefendorf
*Attorney, Agent, or Firm*—E. N. Riddle; H. W. Cummings

[57] ABSTRACT

For application to railway cars having limited available transverse space for the brake system, a system of vertically extending brake levers and longitudinally extending brake rods is used to apply the air brake force to wheels located at opposite ends of the car.

4 Claims, 25 Drawing Figures

VERTICAL RAILWAY CAR AIR BRAKE SYSTEM

REFERENCE TO RELATED APPLICATION

The present application is related to application Ser. No. 404,120, filed on even date herewith, entitled "Hand Brake Arrangement". The entire disclosure of this related application is hereby incorporated into the present application by this reference.

BACKGROUND OF THE INVENTION

In application Ser. No. 272,599 filed June 11, 1981, an articulated container car is disclosed having a hand brake system including vertical levers and transversely extending bell cranks.

However, the bell cranks transfer the hand brake force transversely and the vertical levers are only used in connection with a hand brake system.

In application of an air brake system to railway cars having limited transverse extent, there is insufficient space for the location of transverse air brake levers. However, it is desirable that the air brake system be protected against impacts by a sill or other protective structures on this car.

The object of the present invention is to provide an air brake system comprising vertically extending levers and longitudinally extending rods, which is useful for example where limited transverse space is available for location of the air brakes.

SUMMARY OF THE INVENTION

In accordance with the present invention, an air brake cylinder is mounted longitudinally of the car. An air brake push rod extends outwardly from the air brake cylinder and is connected to a first vertically extending floating cylinder lever. A slack adjuster is connected to a midportion of the floating cylinder lever which extends in a first direction. A first longitudinally extending brake rod is connected to the distal end of the floating cylinder lever which extends in a second direction opposite to the first direction. The first longitudinally extending lever is connected to a first vertically extending brake lever mounted at an opposite end on the car. A second longitudinally extending brake rod is connected to the midportion of the first vertically extending brake lever which is connected at its opposite end to the vertically extending brake beam lever. The brake beam lever is connected to a brake beam which applies the brakes to a wheel located on a first end of the car. The slack adjuster includes a slack adjuster rod extending in the first direction and which is connected to at least one second vertically extending brake lever in the midportion of the second lever. Preferably the distal end of the second vertically extending brake lever is connected to a short longitudinally extending brake rod which is connected to the distal end of a third vertically extending lever pivotably mounted at its upper end to the car body. A long longitudinal brake rod is connected to the midportion of at least one of the second and third vertically extending levers and extends longitudinally in the first direction and is connected at its opposite end to a vertically extending second brake beam lever. The second brake beam lever is fulcrumed to the truck frame and at its opposite end is connected to a brake beam which applies the brakes to a wheel located on the second end of the car.

IN THE DRAWINGS

DETAILED DESCRIPTION OF PREFERRED EMBODIMENTS

Figure 1:
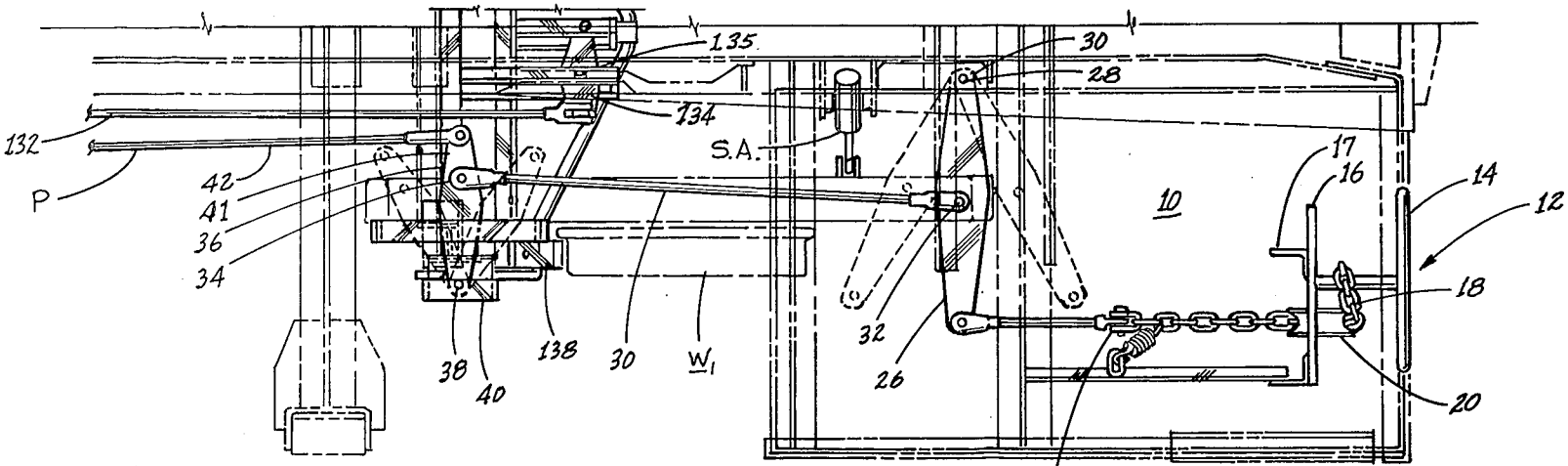
FIG. 1 is a partial plan view of the hand brake arrangement of the present invention.
Figure 2:
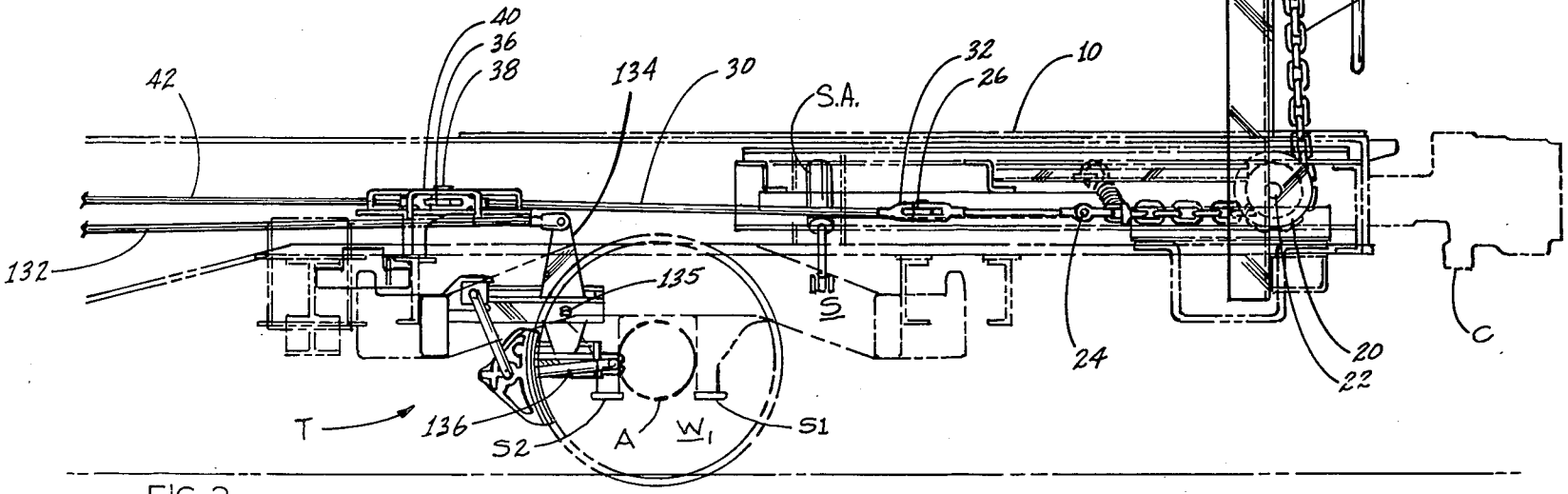
FIG. 2 is a side elevation view of FIG. 1.

The hand brake arrangement of the present invention is mounted upon a railway flat car 10. The railway flat car 10 is supported by a pair of single axle trucks "T" having respective wheels, Wl. The flat car 10 is connected to an adjacent flat car 10' by means of a draw bar (not shown). However, cars of two, four or six units are connected to adjacent cars by means of a conventional coupler "C". A single axle truck "T" includes a longitudinally extending side frame "S" having depending portions "S1" and "S2" which receive a transverse axle A.

The air brake system will now be described. A push rod 68 is located within a piston 70 located within a cylinder 72 receiving air pressure from a conduit 72*a* connected to a vertically extending floating cylinder lever 120. One end of lever 120 is connected to a longitudinally extending lever 122 at 121.

The midportion of floating lever 120 is connected to a slack adjuster 140. Slack adjuster 140 includes a projecting portion 142 which serves as a fulcrum for lever 120 after the portion 142 has been extended a desired amount when push rod 68 is extended.

Lever 122 is connected to a first vertically extending brake lever 124 pivotally mounted at 126 by means of bracket support structure 128. The distal end of lever 124 is connected to rod 122. At its midpoint, lever 124 is connected to another brake rod 132 which is connected to a vertically extending brake beam lever 134. Brake beam lever 134, fulcrumed at 135 is connected to a brake beam 136 extending transversely of the car and includes brake shoes 138 to apply in engaged position a braking force to a wheel W1.

Slack adjuster 140 is connected to a brake rod 144 which is connected in turn to a second vertically extending brake lever 146. Brake lever 146 is pivotally mounted at 148 by means of supportive bracket structure 150. Brake lever 146 at its distal end is connected to a short brake rod 152. Brake rod 152 is connected to a third vertically extending brake lever 154 pivotally mounted at 156 by means of appropriate support bracket structure 158. Brake levers 146 and 154 adjust the brake force by reducing slack adjuster force and locating a top rod 160 to suit requirements of brake beam lever 164. Vertically extending lever 154 is connected at its midpoint 159 to another longitudinally extending brake rod 160 which at its distal end 162 is connected to brake beam lever 164. Lever 164 is provided with a fulcrum 165 to the truck frame and in turn is connected to a transversely extending brake beam 166 having brake shoes 168 which apply the brakes to a wheel W2.

In a similar manner, a vertically extending floating lever 120' located on the second car unit 10' is connected to a longitudinally extending rod 122' which is connected to a first vertically extending brake lever 124'. Lever 124' is connected to a longitudinally extending rod 132' which is connected to a brake beam lever 134'. Brake beam lever 134' thus applies the brake force to a brake beam 136' which applies the brakes to a wheel W3 in the same manner as brake beam 136, through fulcrum 135'.

Likewise, the midportion of floating lever 120 is connected to a slack adjuster rod 142' from a slack adjuster 140'. Slack adjuster 140' in turn is connected to rod 144' connected to a vertically extending lever 146' which is connected to a third brake lever 154' by means of short brake rod 152'. Levers 146' and 154' adjust the applied brake force. Lever 154' is connected at its midpoint 159' to a longitudinally extending lever 160' which is connected to brake beam lever 162' fulcrumed at 165' and connected to brake beam 164'. Brake beam 164' is connected to brake shoes 168' which apply the brakes to wheels W4 in the conventional manner.

The air brake system of the present invention may be used with a hand brake arrangement described in Ser. No. 404,120 filed on even date herewith. The hand brake arrangement 12 includes a hand brake wheel 14 rotatably mounted on a vertically extending hand brake plate 16 supported by angles 17 in a conventional manner. The hand brake wheel 14 is in engagement with a chain 18 which extends around a pulley 20 mounted by means of a suitable pin 22 mounted on the car 10. The chain 18 is connected at its inner end 24 to a horizontally extending hand brake lever 26, which is pivotally mounted at 28 by means of suitable brackets 30. A mechanical advantage is gained and the applied hand brake force is increased from 6,800 pounds to 13,600 pounds. A released position is shown in the leftmost view, a two car applied position in the center view, and an optional three car applied view in the right hand view. A brake rod 30 is connected to the midportion 32 of the lever 26. Brake rod 30, at its inner end 34 is connected to another horizontally extending brake lever 36 pivotally mounted at 38 upon the car 10 by means of suitable support brackets 40. Location of brake rod 30 in this position avoids interferences with the W1 and the truck shock absorber "S". Again the released position for the lever 34 is shown at the left, the two car applied position is shown in the right hand partial view (FIG. 1).

At the distal end of horizontal lever 36, another brake rod 42 is connected. However, it will be noted that while the rod 30 is connected to the lever 26 generally at the midpoint of the lever, the rod 30 is connected to rod 36 at a distance closer to the distal end 43 than to the pivot end 38 in ratio of approximately 5 to 13. Thus while the location of the lever 26 results in an increase in the applied brake force of 6,800 to 13,600 pounds, the location of the lever 36 and its connection point 34 results in a decrease in the brake force of 13/18 or 13,600 pounds to approximately 9,820 pounds.

Figure 5:
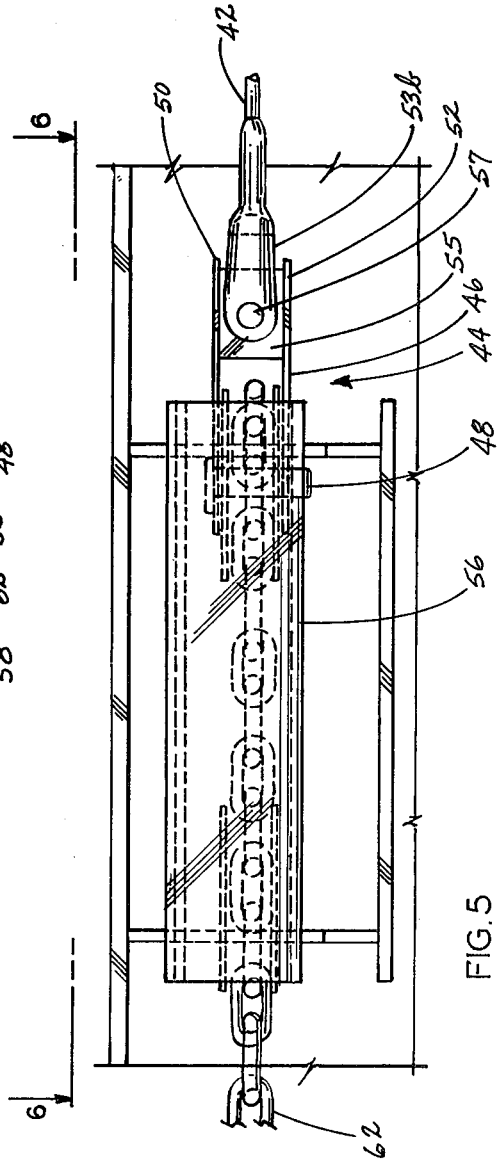
FIG. 5 is an enlarged side elevation view looking in the direction of the arrows along the line 5—5 in FIG. 1A.
Figure 9:
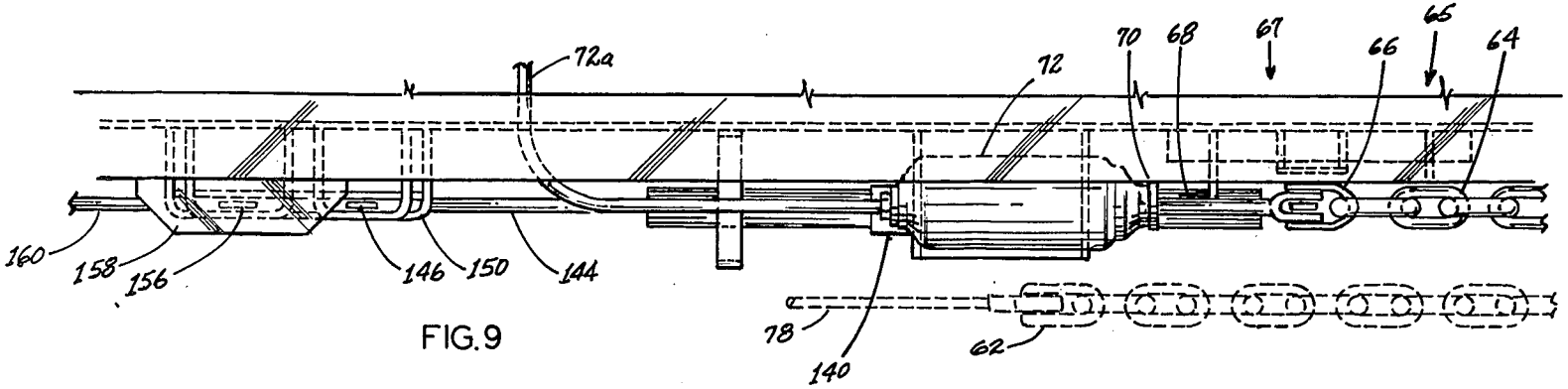
FIG. 9 is a plan view of a portion of FIG. 1A, and is a plan view of FIG. 8.
Figure 8:
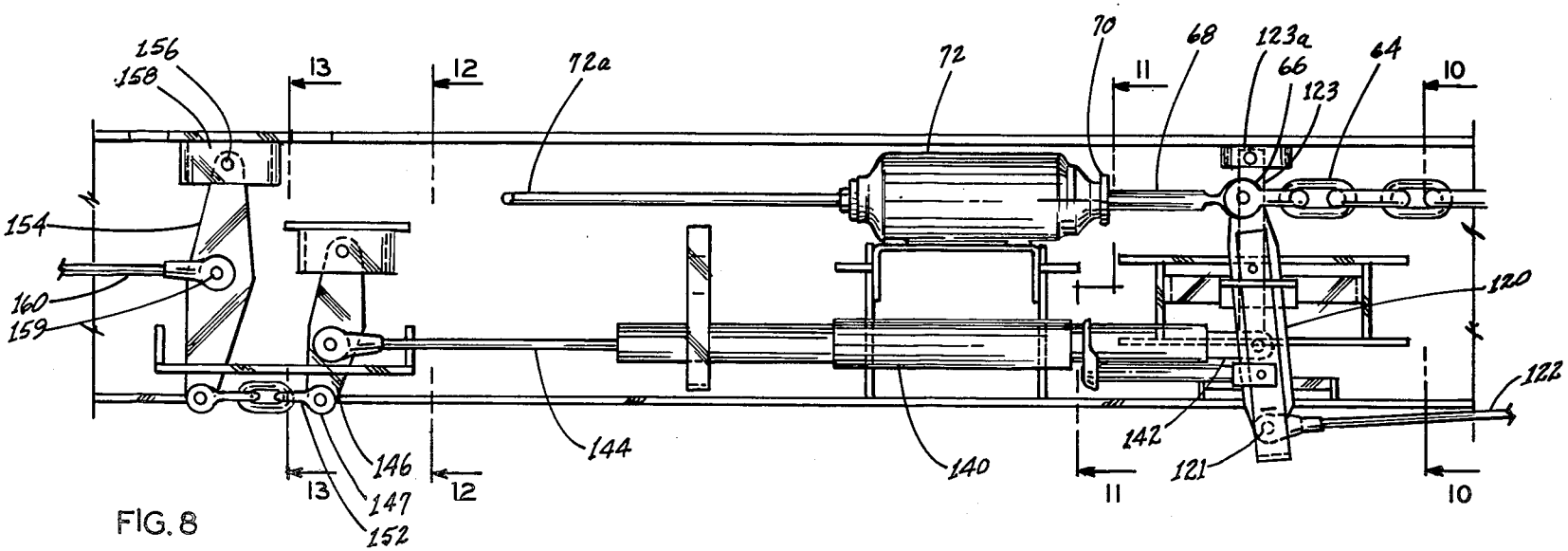
FIG. 8 is an enlarged side elevation view of a portion of FIG. 2A.
Figure 10:
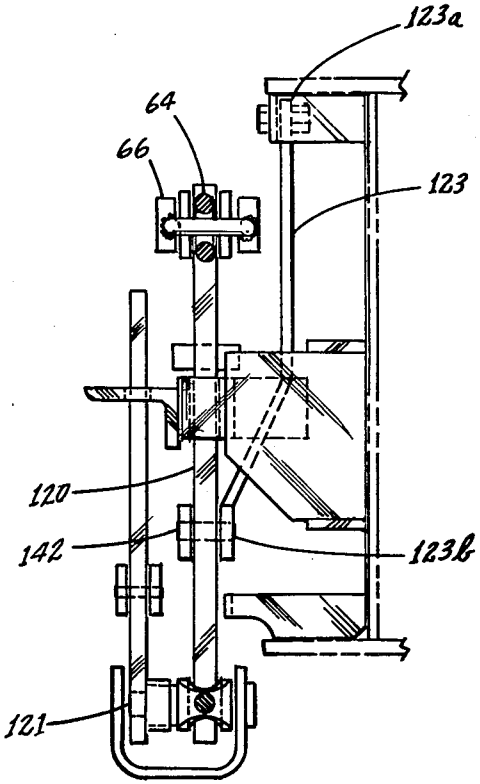
FIG. 10 is an end elevation view looking in the direction of the arrows along the line 10—10 in FIG. 8.
Figure 11:
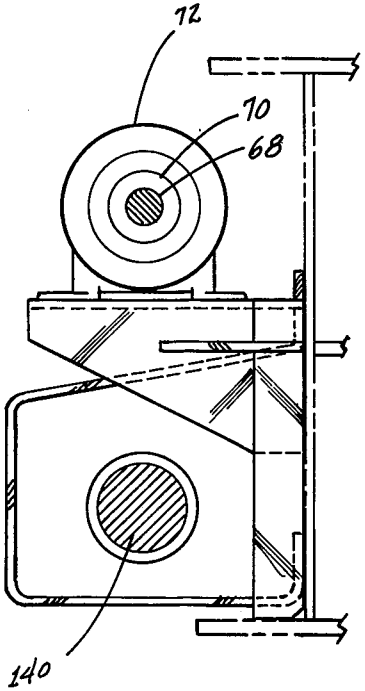
FIG. 11 is an end elevation view looking in the direction of the arrows along the line 11—11 in FIG. 8.
Figure 12:
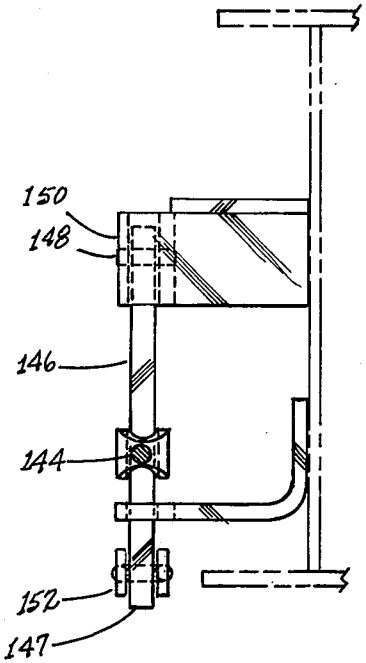
FIG. 12 is an end elevation view looking in the direction of the arrows along the line 12—12 in FIG. 8.
Figure 13:
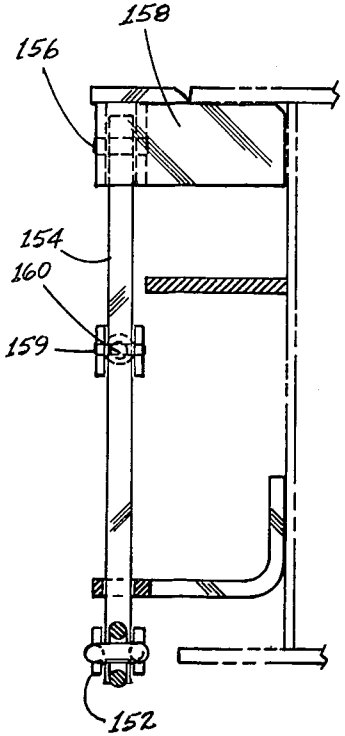
FIG. 13 is an end elevation view looking in the direction of the arrows along the line 13—13 in FIG. 8.

Rod 42 is connected to a first hand brake force dividing means indicated generally at 44. Force dividing means 44 preferably comprises a sheave 46. Rod 42 is bifurcated and includes end pieces 53*a*, 53*b*. A plate 55 extends between the end pieces 53*a* and 53*b* and is welded to cover plates 50 and 52. A fastener 57 extends horizontally through all three members. Sheave 46 is rotatably mounted by means of a vertically extending pin 48 and upper and lower cover plates 50 and 52 (FIG. 5). The assembly of sheave 46, pin 48 and plates 50 and 52 is vertically movable within a closure indicated generally at 54, comprising a channel 56 and a closure plate 58 welded to the channel at 60.

Figure 1A:
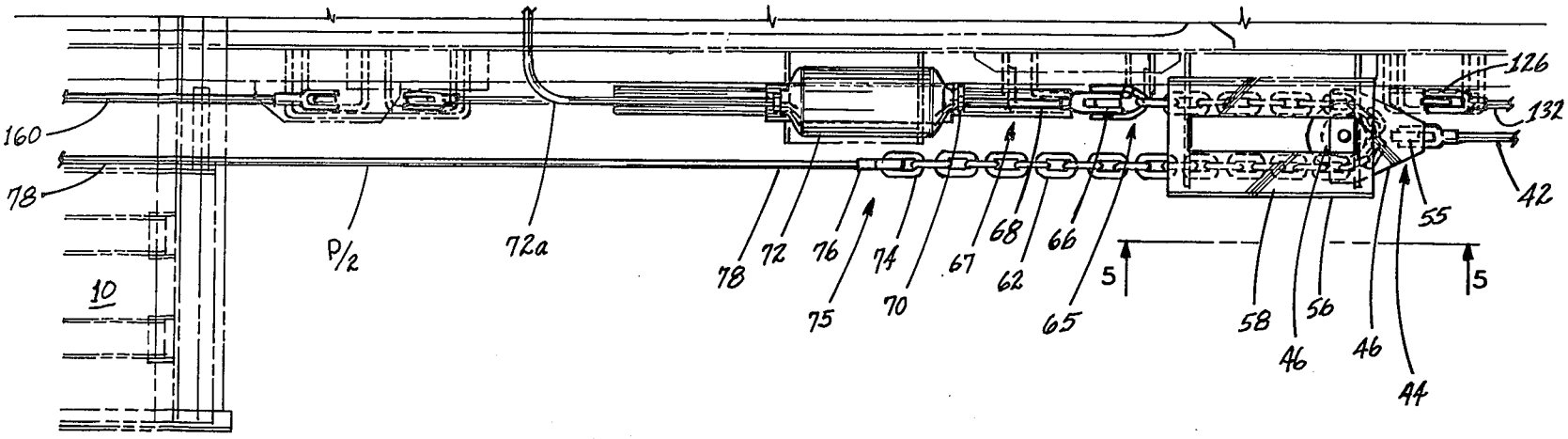
FIG. 1A is a plan view extension of FIG. 1.
Figure 2A:
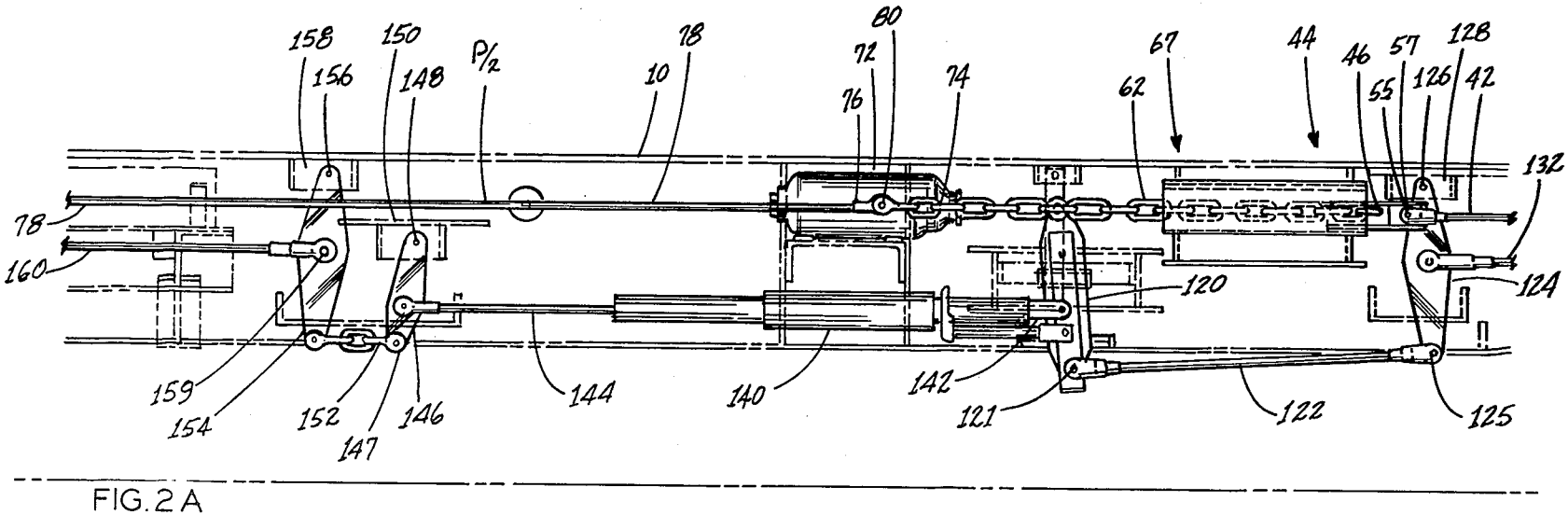
FIG. 2A is a side elevation view extension of FIG. 2, and illustrating a floating cylinder lever according to the present invention.
Figure 1B:
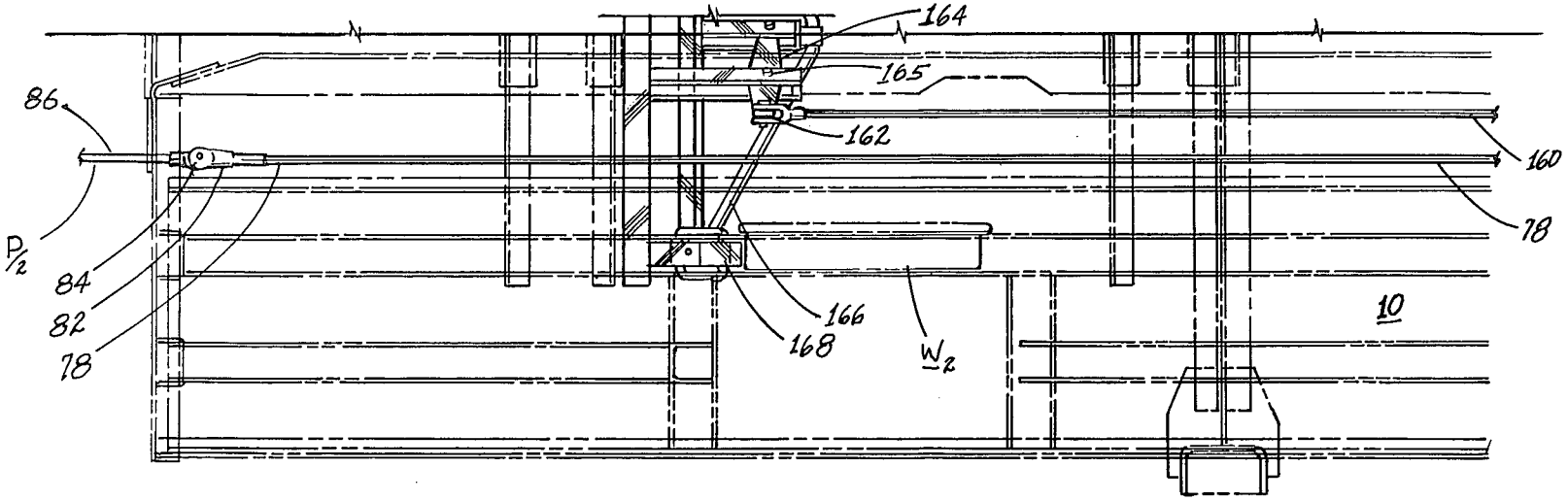
FIG. 1B is a plan view extension of FIG. 1A.
Figure 2B:
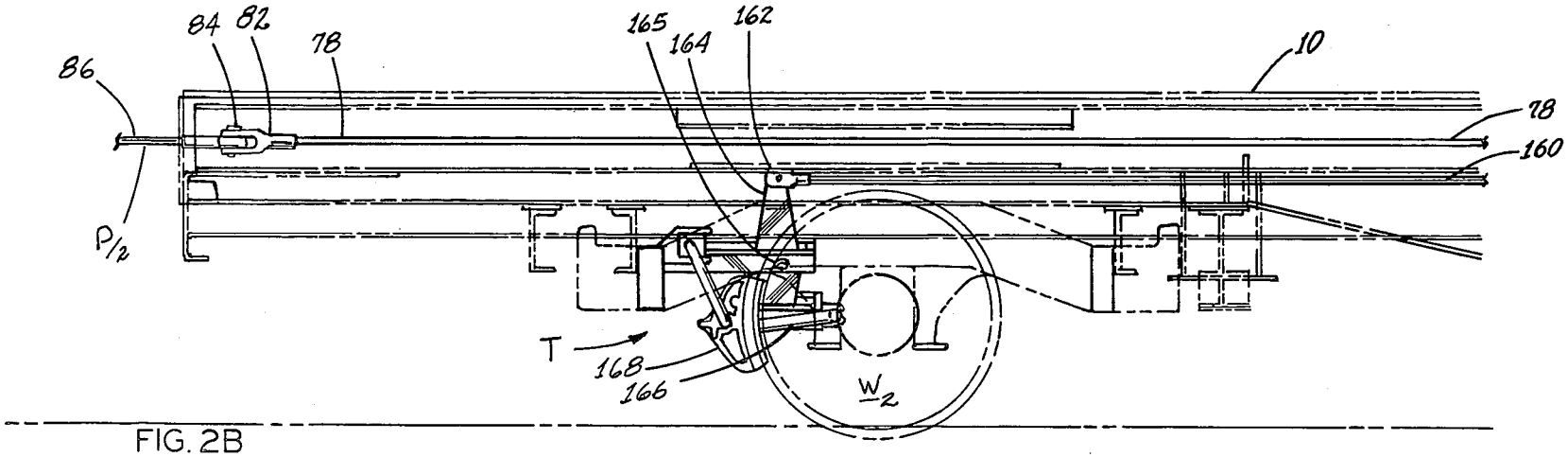
FIG. 2B is a side elevation view extension of FIG. 2A.
Figure 3:
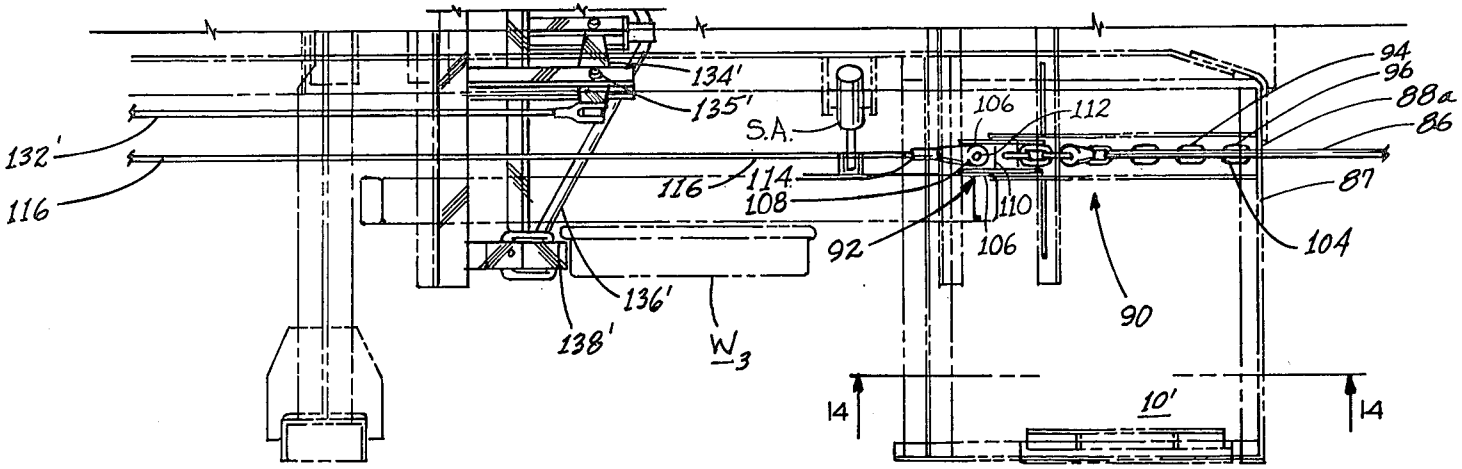
FIG. 3 is a plan view extension of FIG. 1B, and illustrates the connection of the hand brake arrangement to a second car or unit.
Figure 3A:
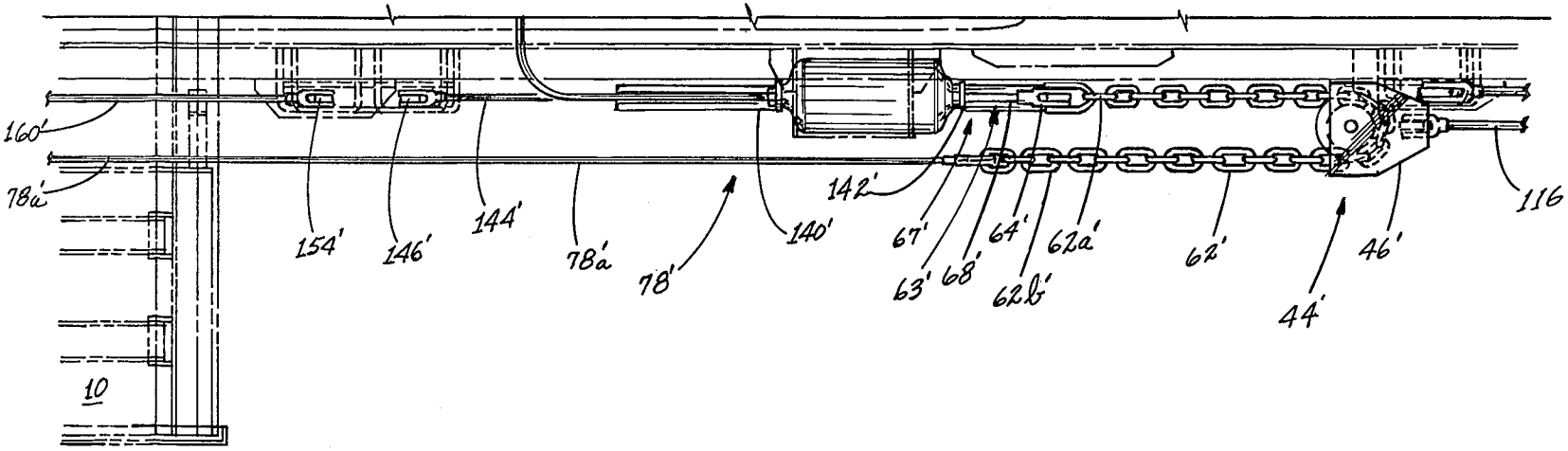
FIG. 3A is a plan view extension of FIG. 3.
Figure 3B:
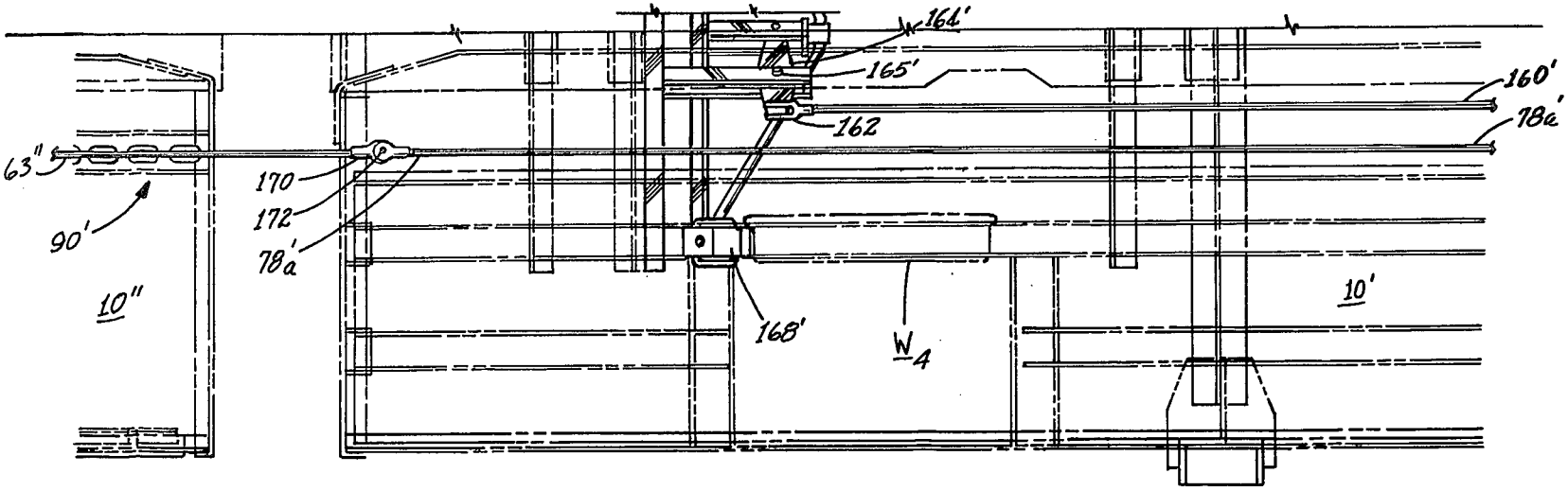
FIG. 3B is a plan view extension of FIG. 3A, and illustrates extending the hand brake arrangement to a third car or unit.

A chain 62 extends about the sheave 46. One end 64 of the chain is connected to a first hand brake linkage means 65 including a clevis 66. The clevis 66 is connected to a first air brake linkage means 67 including a brake cylinder push rod 68 (FIG. 1A). Push rod 68 is located within a hollow brake rod piston 70 which in turn is located within a brake cylinder 72 (FIG. 1A) including an air admitting conduit 72*a* in a conventional manner. When push rod 68 is pulled by clevis 66 the hand brake force is applied to the wheels W1 and W2 through the air brake system in a manner to be described hereafter. As the other end 74 of the chain is connected to a second brake linkage means 75 including a clevis 76 which in turn is connected to a brake rod 78 by means of a pin 80, the result of the application of the sheave 46 is to divide the brake force from rod 42 in half with approximately half being applied to the first air brake linkage means 65 and half applied to the second hand brake linkage means 75 including brake rod 78.

The released position is indicated in the far left relative to rod 78, and the applied position to the right thereof.

The rod 78 then extends down the remaining length of the car and is provided with a bifurcated end 82. A vertically extending pin 84 connects a rod 86 which extends to an adjacent car unit indicated at 10'. Thus the force passing through rod 86 to adjoint unit is P/2 or about 4,000 pounds.

Figure 14:
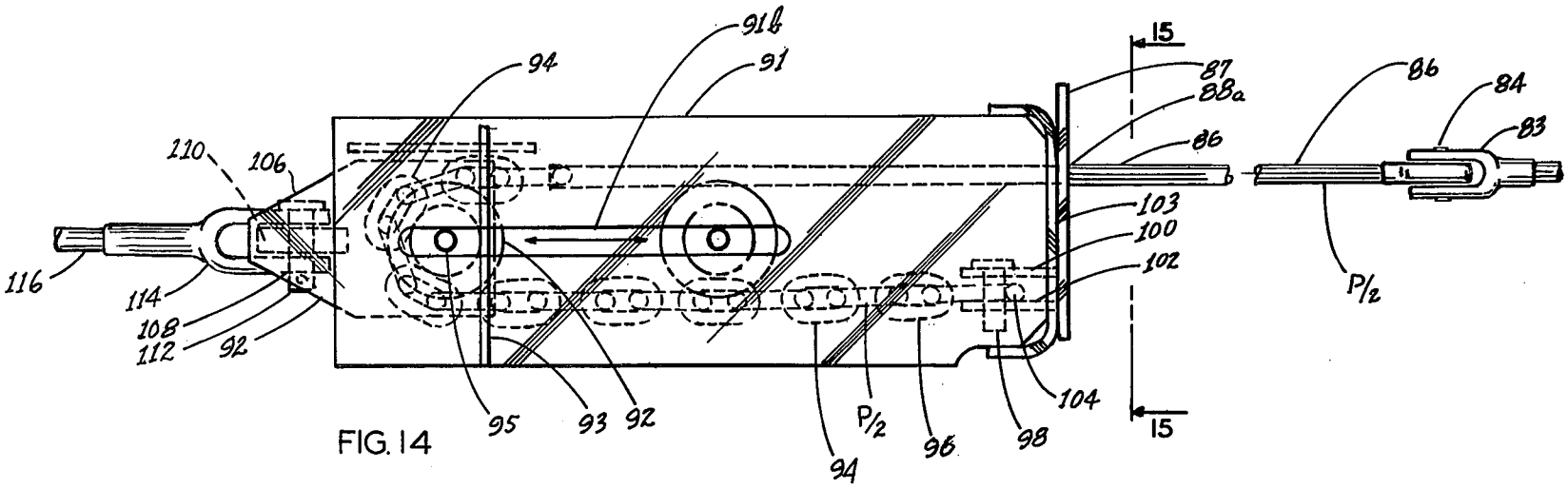
FIG. 14 is a side elevation view of a portion of FIG. 3, and looking in the direction of the arrows along the line 14—14 in FIG. 3.
Figure 15:
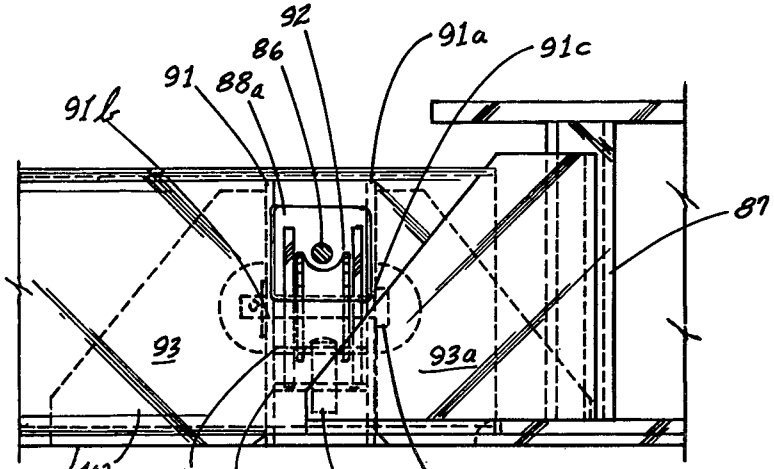
FIG. 15 is an end elevation view of FIG. 14, and looking in the direction of the arrows along the line 15—15 in FIG. 14.
Figure 16:
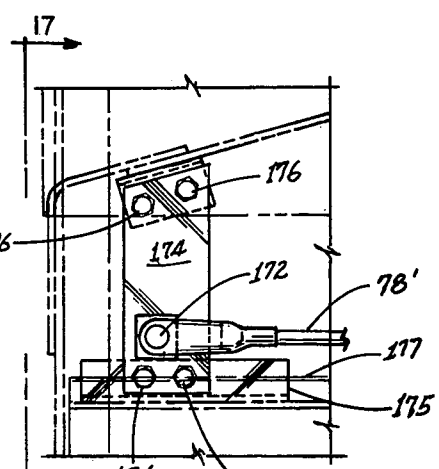
FIG. 16 is a plan view of a portion of FIG. 3B, and illustrating connecting the hand brake arrangement to the end portion of the second car.
Figure 17:
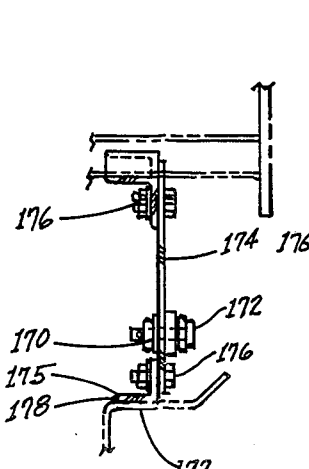
FIG. 17 is an end elevation view looking in the direction of the arrows along the line 17—17 in FIG. 16.

In the adjacent car unit, the rod 86 passes through an opening 88*a* above the end sill and is connected to a force multiplying means 90 including a sheave 92 which includes a chain 94. The opposite end 96 of the chain 94 is connected to the car body as shown in FIG. 14 by means of a vertically extending pin 98, extending through a pair of plates 100 and 102 and a horizontally extending chain link 104. Plates 100 and 102 are welded to a bracket 103 welded to car body 88. Laterally spaced plates 91 and 91*a* (FIG. 15) supported by gussets 93 and 93*a* (FIG. 15) define a channel through which the sheave is longitudinally movable. A pin 95 (FIG. 15) extends between slots 91*b* and 91*c* in plates 91 and 91*a* to provide movement of the sheave. The force in rod 86 is P/2. The force in chain 96 is also P/2. The force at P in 95 to react these forces is thus substantially P, the originally applied hand brake force.

The sheave 92 includes a vertical plate 106 having an opening 108 which receives a horizontally extending plate 110. A pin 112 extends between a bifurcated end 114 of a rod 116 and through plate 110 to connect the sheave to a third hand brake linkage means including a rod 116. The rod 116 is connected to another force dividing means 44' constructed in the same manner as force dividing 44', and including a sheave 46' and a chain 62'. One end of chain 62' is connected to a fourth hand brake linkage means 63' including a clevis 64'. Clevis 64' is connected to a second air brake linkage means 67' including a brake push rod 58'. The other end of the chain 62' is connected to a fifth hand brake linkage means including a rod 78' by a pin 80', all of which is constructed in the same manner as described hereinabove in connection with FIGS. 1–4.

Figure 4:
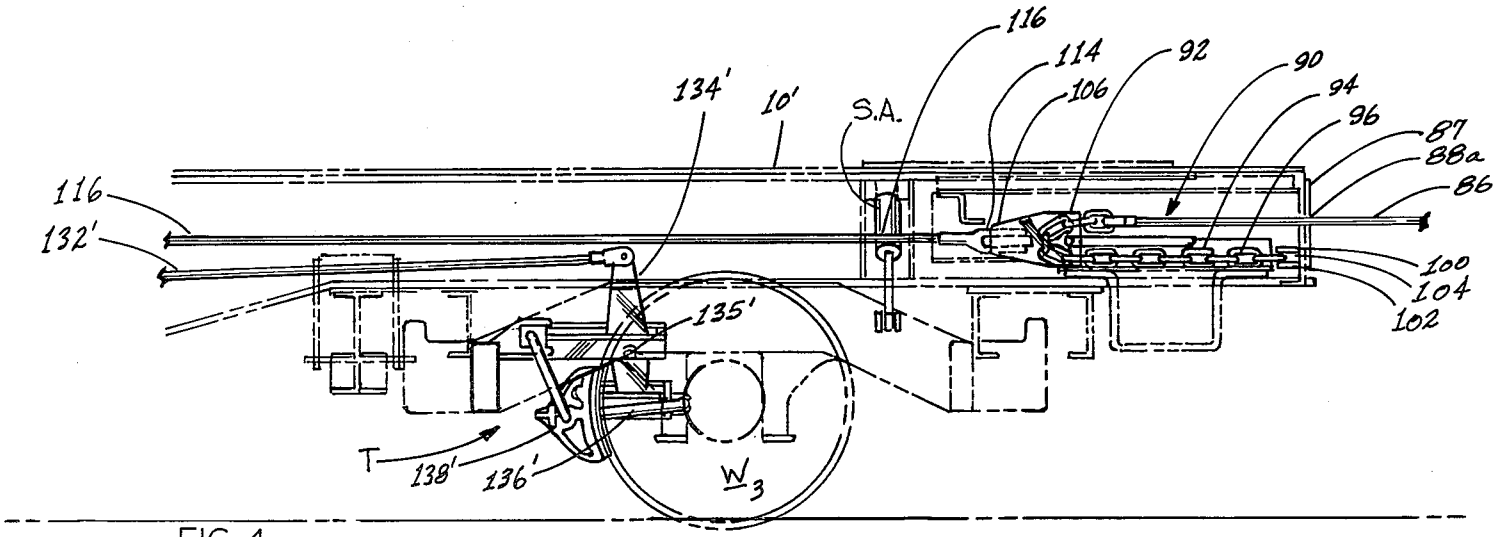
FIG. 4 is a side elevation view extension of FIG. 2B, and also is a side elevation view of FIG. 3.
Figure 4A:
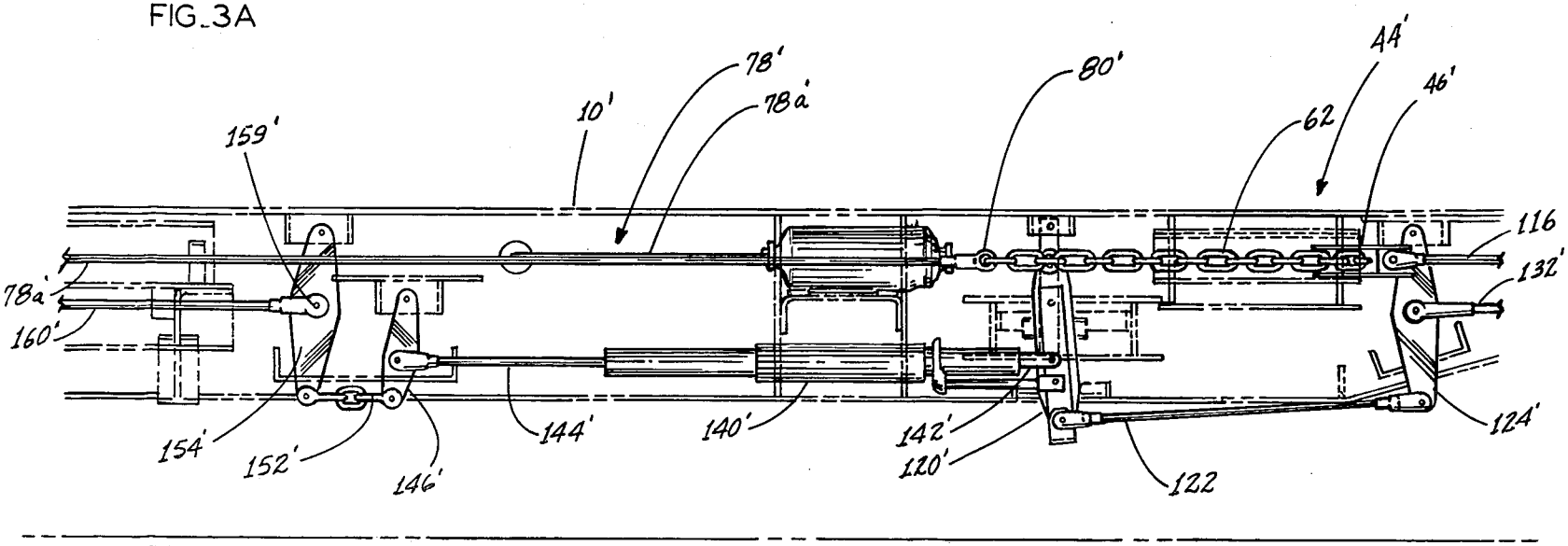
FIG. 4A is a side elevation view extension of FIG. 4, and is a side elevation view of FIG. 3A.
Figure 4B:
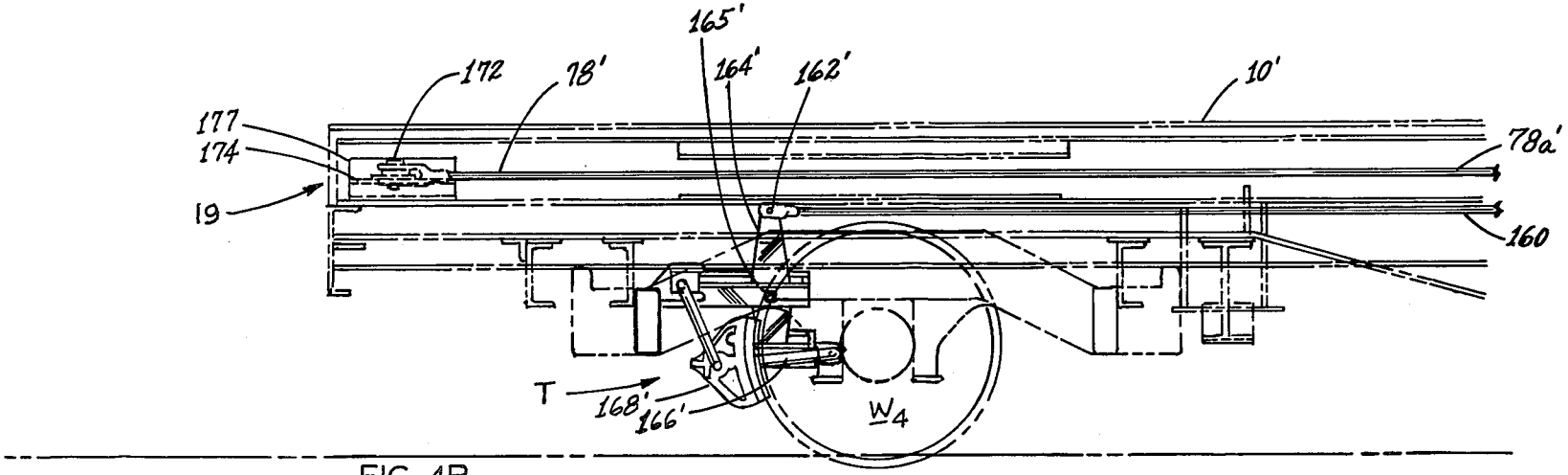
FIG. 4B is a side elevation extension view of FIG. 4A, and is a side elevation view of a portion of FIG. 3B, and illustrating anchoring the hand brake of the present invention to the end of the second car.
Figure 7:
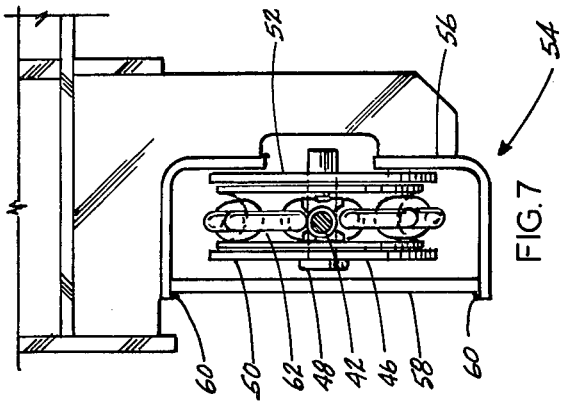
FIG. 7 is an end elevation view of FIG. 6, and looking in the direction of the arrows along the line 7—7 in FIG. 6.
Figure 6:
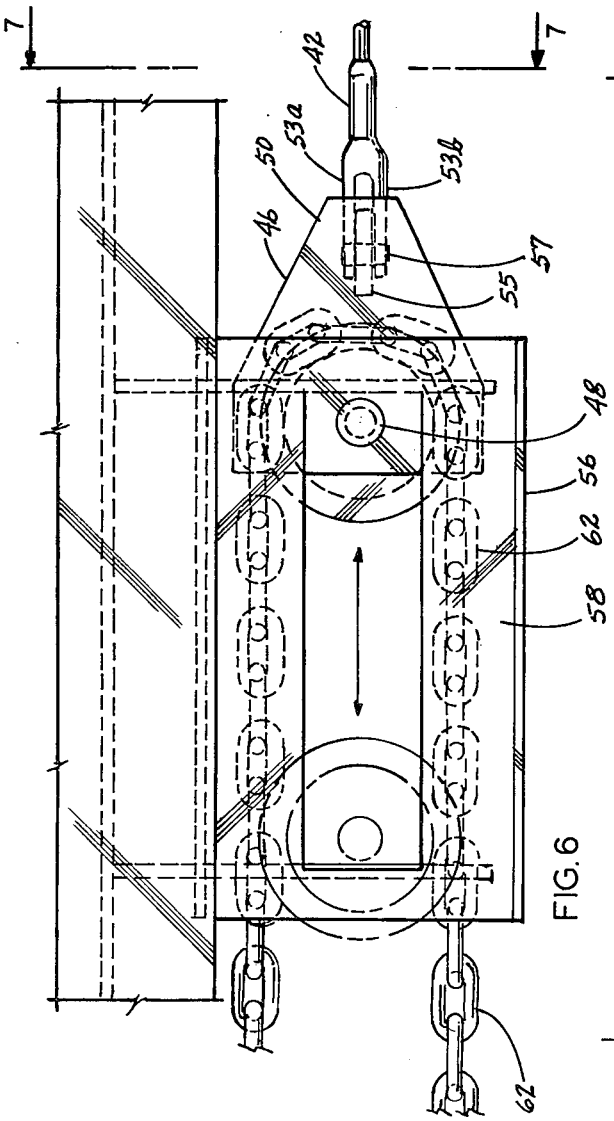
FIG. 6 is a plan view of FIG. 5, and looking in the direction of the arrows along the line 6—6 in FIG. 5.

For a dual car unit, the rod 78 is integrally connected to the car 10' as indicated in the far left portion of FIG. 4B. The rod 78' includes an opening 170 which receives a fastening bolt 172 extending through the plate 174. Plate 174 is held in place with fasteners 176 located at opposite ends thereof. The plate 174 is connected to the center sill at 178 by means of welding.

However, for a three car unit, it would be a simple matter to disconnect rod 78' from the connecting plate 174 and instead connect it to another force multiplying means constructed in the same manner as force multiplying means 90' to restore substantially the original brake force applied by the hand wheel 14 and apply the brakes on the third car through a third air brake linkage means 63''. It is thus seen that with the hand brake arrangement of the present invention, the hand brake can be applied to two or three car units from a wheel located on end unit.

Floating lever 120 is supported by support link 123 pivotally mounted to support bracket structure at 123*a*. The link 123 engages the floating lever and supports the same at 123*b*.

Concerning the operating of floating levers 120 and 120', when wheel 14 is rotated to apply hand brakes, the cylinder lever 120 operates precisely as if an air brake application hand been made. As tension in the rods 122 and the slack adjuster 140 increases, link 123 no longer supports the weight of the slack adjuster 140 because the system is in equilibrium. Positions and ratios are so balanced that the push rod 68 centers in the hollow rod without link 123. Link 123 is necessary to the operation of the system only at release. As tension in the rod 122 and slack adjuster 140 decreases (by release of the brake) vertical up load components on the cylinder level 120 decrease. Link 123 pivots to a vertical position and assumes the load of the cylinder lever 122 and slack adjuster 140. The pivot point 123*b* of link 123 is so located that as the brake rigging relaxes (i.e. as brake forces are released) the slack adjuster weight is supported and the lever 120 further rotates allowing the push rod 68 to return back into the hollow rod 70.

What is claimed is:

1. An air brake arrangement comprising: an air brake cylinder mounted longitudinally of the car; an air brake piston extending outwardly from said air brake cylinder and connecting to a vertically extending floating cylinder lever; a slack adjuster connected to a midportion of the floating cylinder lever and extending a first direction; a first longitudinally extending brake rod connected to the distal end of said floating cylinder lever and extending in a second direction opposite to said first direction; said first longitudinally extending rod connected to a first vertically extending brake lever mounted at its opposite end on the car body; a second longitudinally extending brake rod connected to the midportion of said first vertically extending brake lever, and connected at its opposite end to a first vertically extending brake beam lever; said brake beam lever connected to a brake beam which applies the brakes to a wheel located on a first end of the car; said slack adjuster including a slack adjuster rod extending in said first direction and which is connected to at least one second vertically extending brake lever in the midportion of said second lever; a third longitudinally extending brake rod connected to the midportion of at least one of the second and a third vertically extending levers and extending longitudinally in the first direction; said third longitudinally extending brake rod connected at its opposite end to a vertically extending second brake beam lever; said second brake beam lever connected to a fulcrum means then connected to the truck frame; said second brake beam lever at its opposite end connected to a brake beam which applies the brakes to a wheel located on the second end of the car.

2. An air brake arrangement according to claim 1, wherein the distal end of said second vertically extending lever is connected to short longitudinally extending brake rod which is connected to the distal end of a third vertically extending brake lever pivotably mounted at its upper end to the car body.

3. An air brake arrangement comprising: an air brake cylinder mounted longitudinally of the car; an air brake piston extending outwardly from said air brake cylinder and connected to a vertically extending floating cylinder lever; a slack adjuster connected to a midportion of the floating cylinder lever and extending a first direction; a first longitudinally extending brake rod means connected to the distal end of said floating cylinder lever and extending in a second direction opposite to said first direction; said first longitudinally extending rod means including at least one first vertically extending brake lever mounted at one end on the car body; said longitudinally extending brake rod means connected to a first vertically extending brake beam lever; said brake beam lever connected to a brake beam which applies the brakes to a wheel located on a first end of the car; said slack adjuster including a slack adjuster rod extending in said first direction and which is connected to second longitudinally extending brake rod means including at least one second vertically extending brake lever in the midportion of said second lever; said second longitudinally extending brake rod means connected at its opposite end to a vertically extending second brake beam lever; said second brake beam lever at its opposite end connected to a brake beam which applies the brakes to a wheel located on the second end of the car.

4. An air brake arrangement according to claim 3, wherein said second brake beam lever is connected to a fulcrum means connected to the car body.

* * * * *